US009522530B1

(12) United States Patent
Bas et al.

(10) Patent No.: US 9,522,530 B1
(45) Date of Patent: Dec. 20, 2016

(54) PRINTING APPARATUS

(71) Applicant: Hewlett-Packard Development Company, L.P., Houston, TX (US)

(72) Inventors: Jordi Bas, Sant Cugat del Valles (ES); Laura Portela, Sant Cugat del Valles (ES); Albert Serra, Terrassa (ES)

(73) Assignee: HFWI FTT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/090,531

(22) Filed: Apr. 4, 2016

(51) Int. Cl.
*B41J 2/045* (2006.01)
*B41J 2/21* (2006.01)

(52) U.S. Cl.
CPC ..... *B41J 2/04561* (2013.01); *B41J 2/04586* (2013.01); *B41J 2/2142* (2013.01)

(58) Field of Classification Search
CPC ..... B41J 2/2135; B41J 2/125; B41J 2/2142; B41J 29/393; B41J 2/04561; B41J 2/16579; B41J 2/0451
See application file for complete search history.

(56) References Cited

U.S. PATENT DOCUMENTS 6,568,782 B1 5/2003 Haselby
6,659,584 B2 * 12/2003 Miura ..... B41J 29/393 347/14
6,877,838 B2 * 4/2005 Elgee ..... B41J 2/0451 347/12
8,736,905 B2 5/2014 Barkai et al.
2005/0024414 A1 2/2005 Chong Hin
2015/0053104 A1 2/2015 Schuh et al.

OTHER PUBLICATIONS

Bruijnen, D. et al., Design of a Printhead Alignment Sensor for a Temperature Varying Environment, Feb. 22, 2006, 6 pages.

* cited by examiner

*Primary Examiner* — Thinh H Nguyen
(74) *Attorney, Agent, or Firm* — HP Inc Patent Department

(57) ABSTRACT

A printing apparatus may comprise a print head including nozzles to eject liquid drops, a drop sensor to detect flying liquid drops ejected by at least some of the nozzles, and a controller. The controller is to control at least some of the nozzles to sequentially eject liquid drops while the drop sensor is at a predetermined position relative to the nozzles, to determine the actual position of the drop sensor relative to the nozzles based on a sensor profile including a nozzle location specific signal characteristic of the sequentially ejected liquid drops detected by the drop sensor, and to calculate an offset between the determined actual position and the predetermined position. The controller may take the offset into account in positioning the drop sensor relative to one of the nozzles to detect a liquid drop ejected from that nozzle in a subsequent operation.

15 Claims, 13 Drawing Sheets

PRINTING APPARATUS

BACKGROUND

Printing apparatuses may produce printed images by ejecting liquid from nozzles of a print head. A print head may comprise a plurality of nozzles ranging from two to several thousands of nozzles. The nozzles may be monitored in order to detect one or more nozzles which may not work as desired.

BRIEF DESCRIPTION OF THE DRAWINGS

Various examples will be described below by referring to the following figures, wherein.

The examples and references below generally refer to printing apparatuses, such as page wide printing apparatuses, for instance. The examples of printing apparatuses may comprise one or more print heads comprising a plurality of nozzles through which a liquid, such as liquid ink, may be ejectable. Some printing apparatuses may comprise several thousands of nozzles that may be controlled independently from each other.

A controller may control the nozzles such that a drop of liquid may be ejected at a predetermined point of time. For example, the nozzles may eject droplets of ink at a certain point of time when a printing medium, such as a paper to be printed, is in a predetermined position relative to the nozzles such that the print job is correctly executed and the result of the print is as desired.

Some examples of printing apparatuses may comprise one or more print heads which may be arranged in parallel in the printing apparatus. For example, in page wide printing apparatuses, a certain number of print heads may be arranged in a row such that the row of print heads may extend over the entire width of the fed medium to be printed.

According to an example, a printing apparatus may comprise eight print heads which may be arranged in a row on a print bar. The print bar may be arranged in the printing apparatus such that the single print heads are fixed in their position relative to each other and relative to the print bar, i.e., the single print heads are not movable.

In some examples, the printing apparatus may comprise a drop sensor to monitor nozzle health. The drop sensor may scan each of the nozzles of the one or more print heads, i.e., the drop sensor may monitor whether a drop of liquid is ejected from a certain nozzle at a predetermined point of time.

Thus, the drop sensor may be used to detect a nozzle that is not properly working, for example if the nozzle is clogged or if an ink supply may be empty. In some examples, the drop sensor may be arranged in a predetermined, or nominal, position relative to the nozzles in order to monitor these nozzles. In some examples, this predetermined position may deviate from the actual position of the drop sensor, for instance, due to a misalignment during manufacturing, mechanical stress or the like. According to an example, it is good when a deviation between the predetermined position and the actual position of the drop sensor relative to the nozzles may be low.

Figure 1:
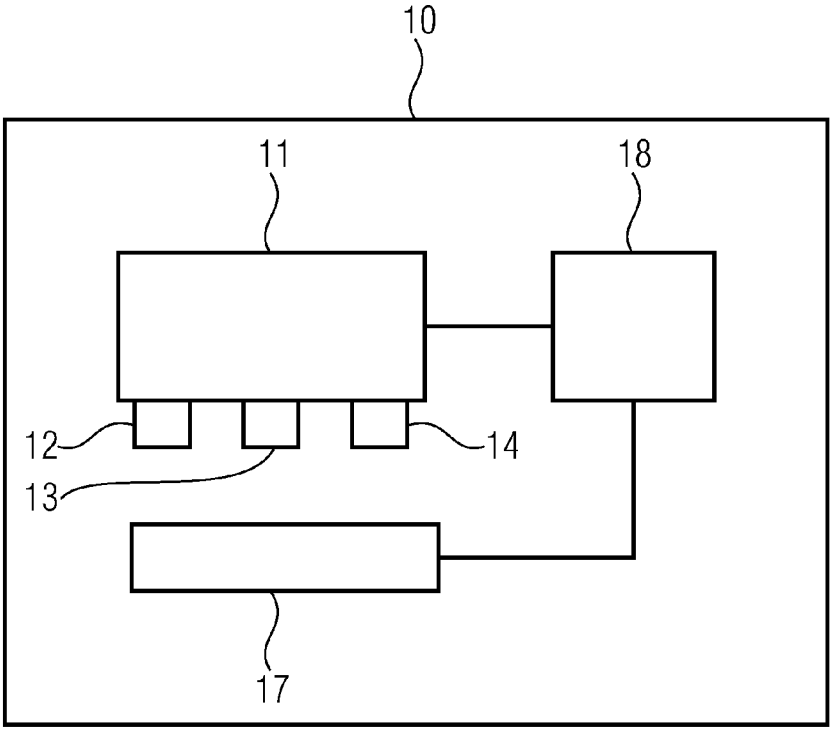
FIG. 1 is a block diagram of a printing apparatus according to an example.

FIG. 1 shows a block diagram of an example of a printing apparatus 10. The printing apparatus 10 may comprise a print head 11 including nozzles 12, 13, 14 to eject liquid drops. The printing apparatus 10 may further comprise a drop sensor 17 to detect flying liquid drops ejected by at least some of the nozzles 12, 13, 14.

Printing apparatus 10 may further comprise a controller 18. The controller 18 may control at least some of the nozzles 12, 13, 14 to sequentially eject liquid drops while the drop sensor 17 is at a predetermined position relative to the nozzles 12, 13, 14.

The controller 18 may further determine the actual position of the drop sensor 17 relative to the nozzles 12, 13, 14 based on a sensor profile including a nozzle location specific signal characteristic of the sequentially ejected liquid drops detected by the drop sensor 17.

The controller 18 may further calculate an offset between the determined actual position of the drop sensor 17 and the predetermined position of the drop sensor 17 relative to the nozzles 12, 13, 14.

The controller 18 may further take the calculated offset into account in positioning the drop sensor 17 relative to one of the nozzles 12, 13, 14 to detect a liquid drop ejected from that nozzle 12, 13, 14 in a subsequent operation.

Figure 2:
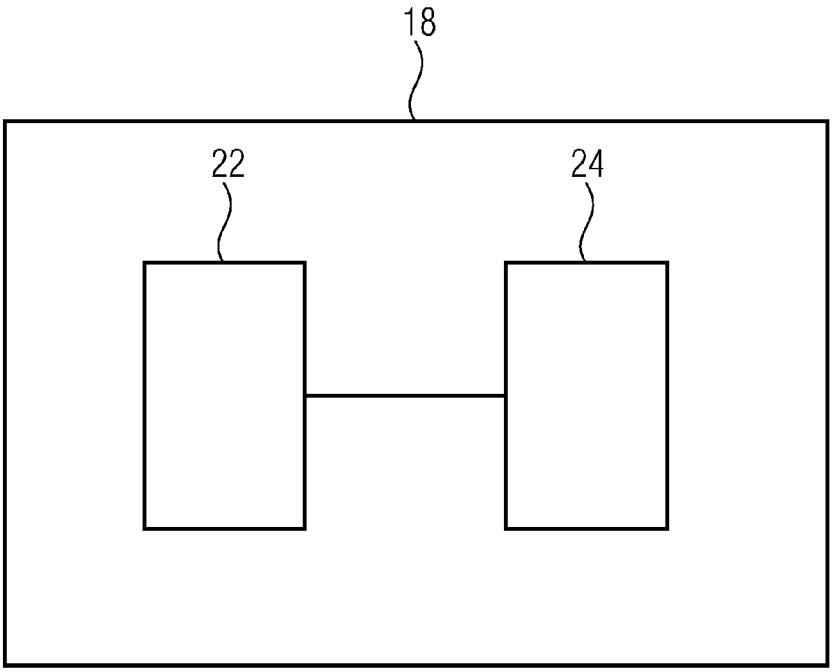
FIG. 2 is a block diagram of a controller according to an example.

FIG. 2 shows a block diagram of an example of a controller 18. Controller 18 may be to provide the functionality described herein and to execute methods described herein. Controller 18 may be implemented, for example, by one or more discrete modules, or data processing components, that are not limited to any particular hardware and machine readable instructions configuration. Controller 18 may be implemented in any computing or data processing environment, including in digital electronic circuitry, e.g., an application-specific integrated circuit, such as a digital signal processor (DSP) or in computer hardware, device driver, or machine readable instructions. In some implementations, the functionalities are combined into a single data processing component. In other implementations, the respective functionalities may be performed by a respective set of multiple data processing components.

As shown in FIG. 2, controller 18 may comprise a processor 22 and a memory device 24 accessible by processor 22. Memory device 24 may store process instructions, for example machine-readable instructions, such as computer software, for implementing methods executed by controller 18. Memory device 24 may store instructions to control components of the printing apparatus to perform the recovery sequences described herein. Memory device 24 may include one or more tangible machine-readable storage media. Memory devices suitable for embodying these instructions and data may include all forms of computer-readable memory, including, for example, semiconductor memory devices, such as EPROM, EEPROM, and flash memory devices, magnetic disks such as internal hard disks and removable hard disks, magneto-optical disks, and ROM/RAM devices. Routines and processes applied to the print head to perform the recovery sequences described herein may be stored in memory device 24.

Figure 3:
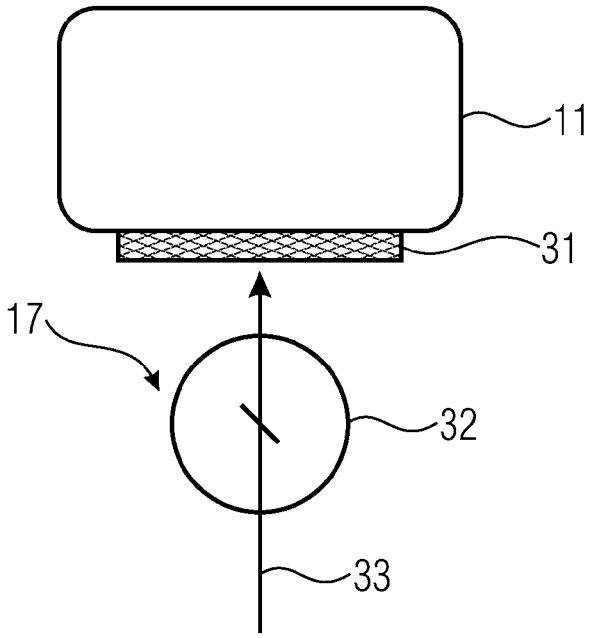
FIG. 3 is a schematic view of an example of a print head and a drop sensor in a predetermined position.

FIG. 3 shows an example of a print head 11. The print head 11 may comprise a plurality of nozzles wherein said nozzles may, for example, be provided in a nozzle bar 31. Nozzle bar 31 may be a nozzle chip, such as a nozzle die comprising semiconductor material, for example.

Drop sensor 17 may have a sensor field 32 or a sensor area 32 which describes the area where the drop sensor 17 may measure or detect flying drops ejected by the nozzles. In other words, liquid drops which fly through the sensor area 32 can be detected by the drop sensor 17.

The drop sensor 17 may be positioned at a predetermined position relative to the nozzles. This predetermined position is depicted in FIG. 3 by an arrow 33 pointing to a certain position at the nozzle bar 31.

Figure 4:
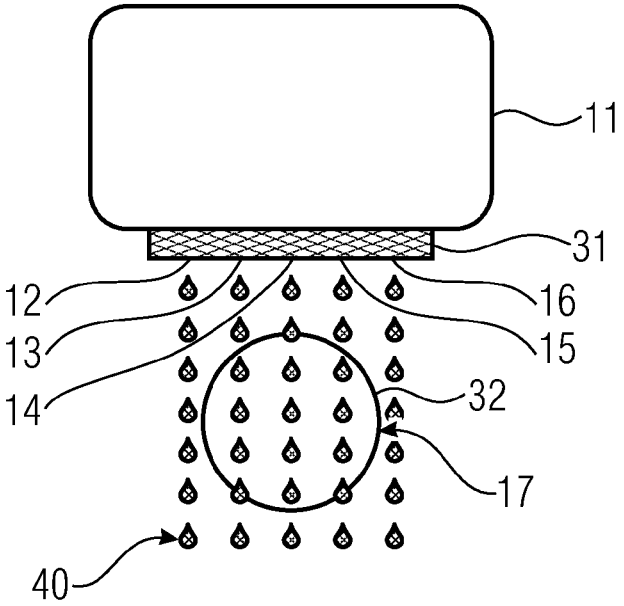
FIG. 4 is a schematic view of an example of a print head and a drop sensor in a predetermined position when liquid drops are ejected by nozzles.

FIG. 4 shows the print head 11 when liquid drops 40 are ejected by the nozzles. The nozzle bar 31 may comprise a plurality of nozzles 12, 13, 14, 15, 16 each of which may eject a liquid drop 40. Liquid drops 40 which pass the sensor area 32 may be detected by the drop sensor 17.

The drop sensor 17 may detect flying liquid drops 40. As described above, the nozzles 12, 13, 14, 15, 16 may eject liquid drops 40. Liquid drops 40 that have been ejected by the nozzles are free falling due to the force of gravity. Such free falling liquid drops that have been ejected by the nozzles but have not yet arrived at a portion of the printing apparatus or a portion of a printing medium can be considered as flying liquid drops. In other words, ejected liquid drops 40 which are free falling and which are located somewhere in the air may be considered as flying liquid drops. As mentioned above, the drop sensor 17 may detect such flying liquid drops 40.

The controller 18 (FIG. 1) may control at least some of the nozzles 12, 13, 14, 15, 16 to sequentially eject liquid drops 40 while the drop sensor 17 is at the predetermined position 33. Accordingly, the nozzles 12, 13, 14, 15, 16 may eject a liquid drop one after the other, i.e., nozzle 12 may eject a liquid drop at a first time instant $t_1$, nozzle 13 may eject a liquid drop at a subsequent time instant $t_2$, and so on. However, in some examples, each of the nozzles 12, 13, 14, 15, 16 may eject a liquid drop at the same time.

Figure 5:
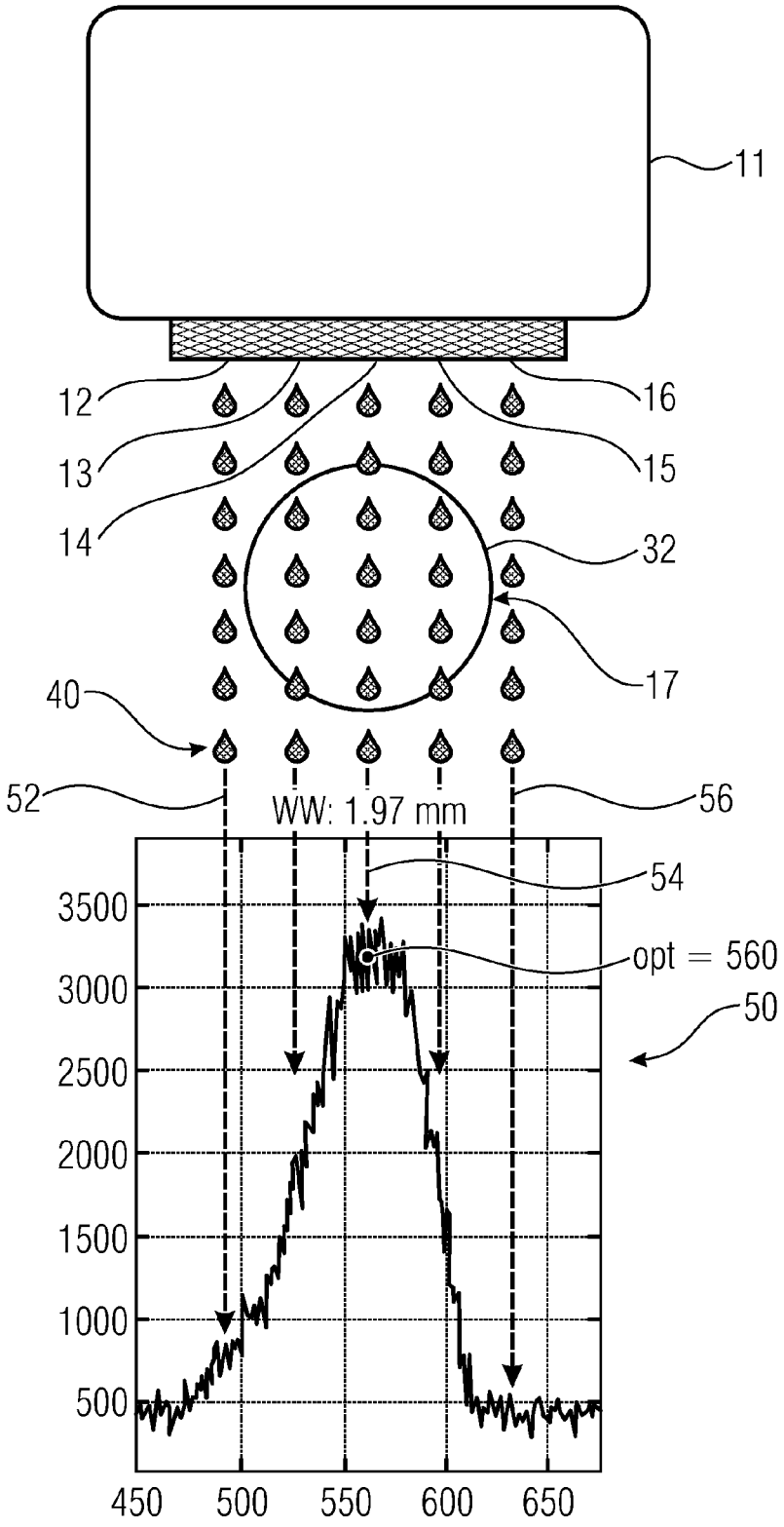
FIG. 5 is an example of a sensor profile.

FIG. 5 shows the print head 11, the drop sensor 17 and an example of a sensor profile 50. The sensor profile 50 may include a nozzle location specific signal characteristic of the sequentially ejected liquid drops 40 detected by the drop sensor 17. In the example shown in FIG. 5, the nozzle location specific signal characteristic of an ejected liquid drop 40 may be the signal strength of a detected liquid drop 40 ejected by a certain nozzle, or the signal strength of a series of detected liquid drops 40 sequentially ejected by a certain nozzle, respectively.

As mentioned above, the drop sensor 17 may detect liquid drops 40 that fly through the sensor area 32. Liquid drops 40 ejected by a nozzle that is close to the center of the sensor area 32, such as nozzle 14, for instance, may generate a signal having a high signal strength, which is indicated, by way of example, by the signal strength value to which arrow 54 point.

Liquid drops 40 ejected by nozzles that are positioned more outside the center or at the edge of the sensor area 32, such as nozzles 12 and 16, for instance, may generate a signal having a low signal strength, which is indicated, by way of example, by the signal strength values to which arrows 52 and 56 point.

Accordingly, the drop sensor 17 is to determine a signal strength of a detected ejected liquid drop 40 and to allocate the detected liquid drop 40 to the respective nozzle that ejected this liquid drop 40.

The sensor area 32 may comprise a width so as to cover a plurality of nozzles ranging from one nozzle to several tens, hundreds or thousands of nozzles. The drop sensor 17 may detect liquid drops 40 which are ejected by the plurality of nozzles and to determine the signal strength of the ejected liquid drops 40 at each nozzle location. Accordingly, the drop sensor 17 may be to determine a nozzle location specific signal characteristic.

The controller 18 may create sensor profile 50 which contains a nozzle location specific signal characteristic and a nozzle number, or nozzle ID. The sensor profile 50 may allocate a certain signal characteristic with an individual nozzle ID. Thus, the signal characteristics in the sensor profile are nozzle location specific signal characteristics.

Figure 6:
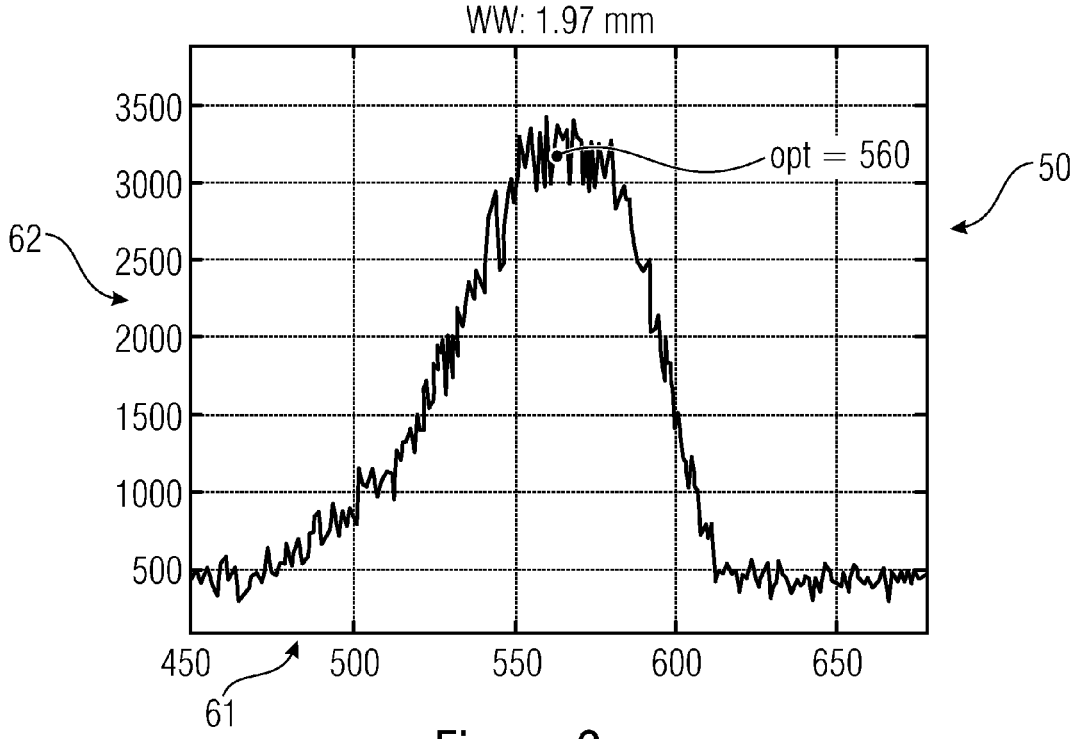
FIG. 6 is a further example of a sensor profile.

The previously discussed example sensor profile 50 depicted in FIG. 5 is shown in more detail in FIG. 6. At the X-axis 61 of the sensor profile 50, the individual nozzle numbers or nozzle IDs are plotted. At the Y-axis 62 of the sensor profile 50, the signal strength is plotted. In this example, the nozzle IDs range from 450 to 650, and the signal strengths range from 0 to 4000 units.

As will be explained in more detail below, the controller 18 is to determine the actual position of the drop sensor 17 relative to the nozzles based on the sensor profile 50.

As the controller 18 is aware of the predetermined position 33 (FIG. 3) of the drop sensor 17 relative to the nozzles, and since the controller 18 is to determine the actual position of the drop sensor 17 based on the sensor profile 50, the controller 18 is to calculate an offset between the predetermined position 33 and the actual position of the drop sensor 17.

The controller 18 may use this calculated offset for positioning the drop sensor 17 relative the nozzles in subsequent operations. A subsequent operation may, for example, be a nozzle health monitoring, wherein the drop sensor 17 may be positioned relative to certain ones of the plurality of nozzles in order to detect whether liquid drops 40 are ejected from these nozzles or not. During this subsequent operation, the calculated offset between the predetermined position and the actual position of the drop sensor 17 may be taken into account by the controller 18.

Figure 7:
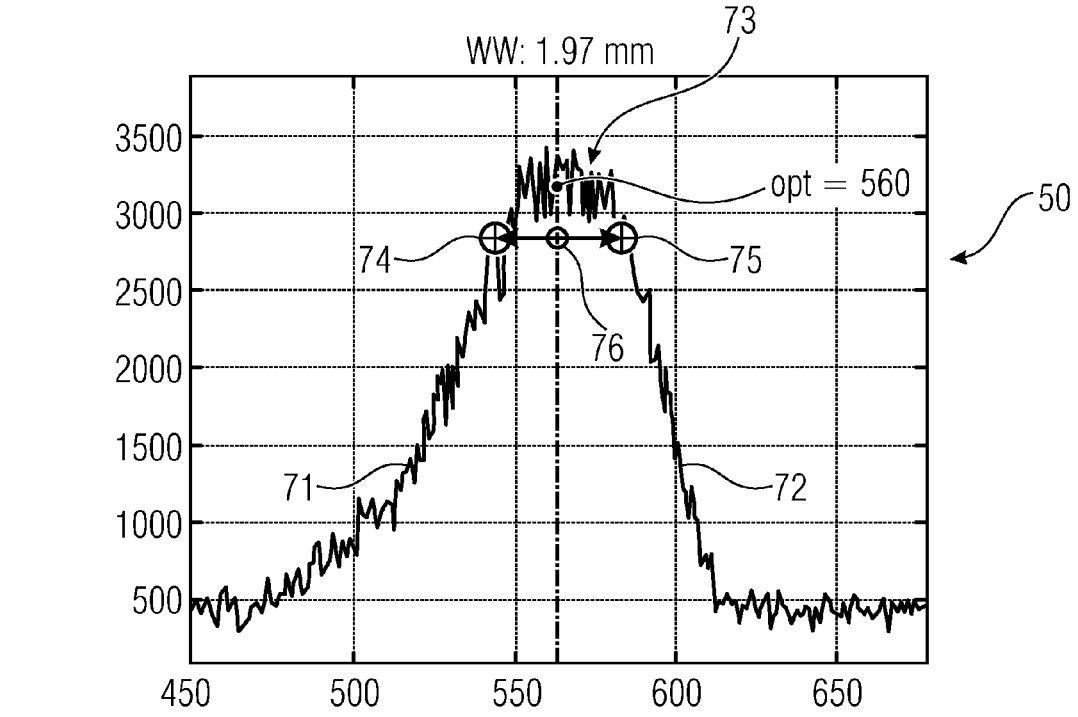
FIG. 7 is a further example of a sensor profile.

FIG. 7 shows an example how the controller 18 may determine the actual position of the drop sensor 17 based on the aforementioned sensor profile 50. As can be seen, the sensor profile 50 may have a shape comprising a rising portion 71, a falling portion 72 and a global maximum 73 between the rising portion 71 and the falling portion 72.

In this example, the sensor profile 50 may comprise a global maximum 73 at nozzle ID 560 (X-axis). Accordingly, based on the global maximum 73 of the sensor profile 50, the controller 18 is to determine the actual position of the drop sensor 17. In other words, the controller 18 determines, in this example, that the actual position of drop sensor 17 is at nozzle number 560, i.e., at the nozzle having the nozzle ID 560, respectively.

The global maximum 73 may be determined by the controller 18, for example, by determining a middle point between two nozzle location specific signal characteristics having the same value and being associated with nozzles spaced apart by more than a predetermined distance.

Still with reference to FIG. 7, it can be seen that the sensor profile 50 comprises two nozzle location specific signal characteristics 74, 75 having the same value. The first nozzle location specific signal characteristic 74 is located at the rising portion 71 of the sensor profile 50, and the second nozzle location specific signal characteristic 75 having the same value is located at the falling portion 71 of the sensor profile 50.

The first nozzle location specific signal characteristic is a signal strength value of about 2800 units, and is represented by data point 74. The second nozzle location specific signal characteristic is a signal strength with the same value, i.e. of about 2800 units, and is represented by data point 75.

The controller 18 is to determine the middle point 76 between these two nozzle location specific signal characteristics 74, 75.

Furthermore, as can be seen in the sensor profile 50, the first nozzle location specific signal characteristic 74 may be associated with nozzle number 540, while the second nozzle location specific signal characteristic 75 may be associated with nozzle number 580. Accordingly, the two nozzle location specific signal characteristics 74, 75 are associated with nozzles that are spaced by a certain distance, namely by the distance between nozzle number 540 and nozzle number 580, i.e., by a distance of 40 nozzles.

Furthermore, the controller 18 may determine the middle point 76 if the distance between the two nozzle location specific signal characteristics 74, 75 is greater than a predetermined distance. For example, if the predetermined distance may be a distance of 20 nozzles, than the distance of the two nozzle location specific signal characteristics 74, 75 (40 nozzles) is greater than the predetermined distance of 20 nozzles. In other words, the two signal strength values 74, 75 may derive from two nozzles that are spaced from each other by a predetermined minimum distance.

The controller 18 may take the determined middle point 76 as the actual position of the drop sensor 17. Accordingly, the controller 18 may determine that the actual position of the drop sensor 17 may be the middle point 76 between the first nozzle location specific signal characteristic 74 at nozzle number 540 and the second nozzle location specific signal characteristic 75 at nozzle number 580. The middle point between nozzle number 540 and nozzle number 580 is nozzle number 560, as shown in FIG. 7.

Figure 8:
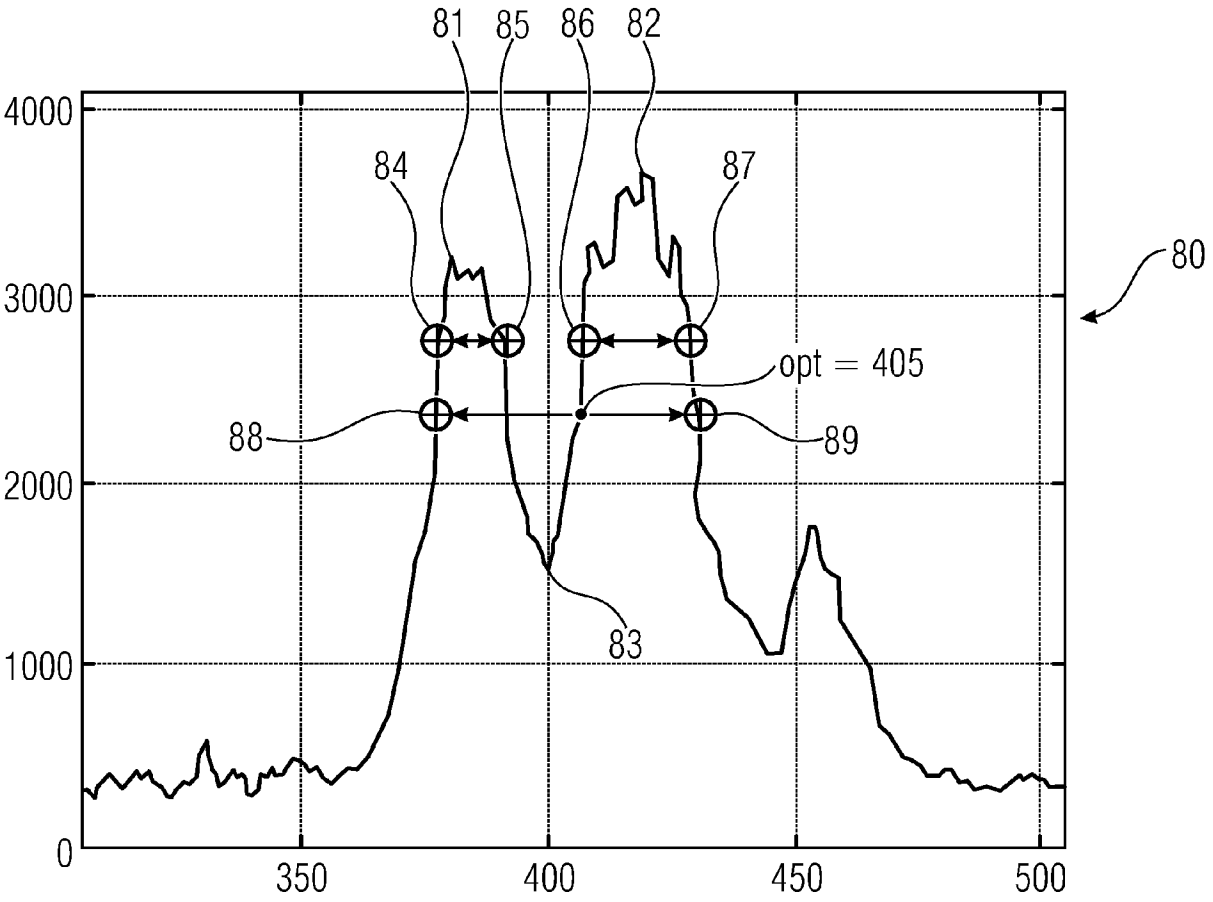
FIG. 8 is a further example of a sensor profile.

FIG. 8 shows a further example of a sensor profile 80. In comparison to previously discussed sensor profile 50, this sensor profile 80 comprises a different shape. Sensor profile 80 comprises two peaks 81, 82 and a valley 83 between the two peaks 81, 82.

At the first signal peak 81 two nozzle specific signal characteristics 84, 85 having the same value (about 2800 units) are shown. At the second signal peak 82 two further nozzle specific signal characteristics 86, 87 having the same value (about 2800 units) are shown. However, these nozzle location specific signal characteristics 84, 85 and 86, 87 may not be spaced apart by more than a predetermined distance. Thus, the controller 18 may not take these nozzle location specific signal characteristics 84, 85, 86, 87 into account in determining the actual position of the drop sensor 17.

For example, nozzle location specific signal characteristic 84 may be associated with nozzle ID 370 and nozzle location specific signal characteristic 85 may be associated with nozzle ID 390. Accordingly, these two nozzle location specific signal characteristics 84, 85 may be spaced by a distance of 20 nozzles.

For example, nozzle location specific signal characteristic 86 may be associated with nozzle ID 410 and nozzle location specific signal characteristic 87 may be associated with nozzle ID 435. Accordingly, these two nozzle location specific signal characteristics 86, 87 may be spaced by a distance of 25 nozzles.

If, for example, a predetermined distance would be a distance of 30 nozzles or more, than both pairs of nozzle location specific signal characteristics, i.e., the first pair of nozzle location specific signal characteristics 84, 85 (distance of 20 nozzles), and the second pair of nozzle location specific signal characteristics 86, 87 (distance of 25 nozzles), would be spaced from each other by less than the predetermined distance of 30 nozzles. Thus, the controller 18 may not take these nozzle location specific signal characteristics 84, 85, 86, 87 into account in determining the actual position of the drop sensor 17.

Still with reference to FIG. 8, the controller 18 may take a first nozzle location specific signal characteristic 88 at a rising portion of the first signal peak 81, and a second nozzle location specific signal characteristic 89 at a falling portion of the second signal peak 82.

The first nozzle location specific signal characteristic 88 may be associated with nozzle ID 375 and the second nozzle location specific signal characteristic 89 may be associated with nozzle ID 435. Accordingly, the two nozzle location specific signal characteristics 88, 89 are spaced by a distance of 60 nozzles, i.e., the two nozzle location specific signal characteristic 88, 89 are associated with nozzles being spaced by more than a predetermined distance, which may be 30 nozzles, for instance. Thus, the controller 18 may determine the middle point of these two nozzle location specific signal characteristics 88, 89 which is associated with nozzle ID 405. This middle point is the actual position of the drop sensor 17.

Figure 9:
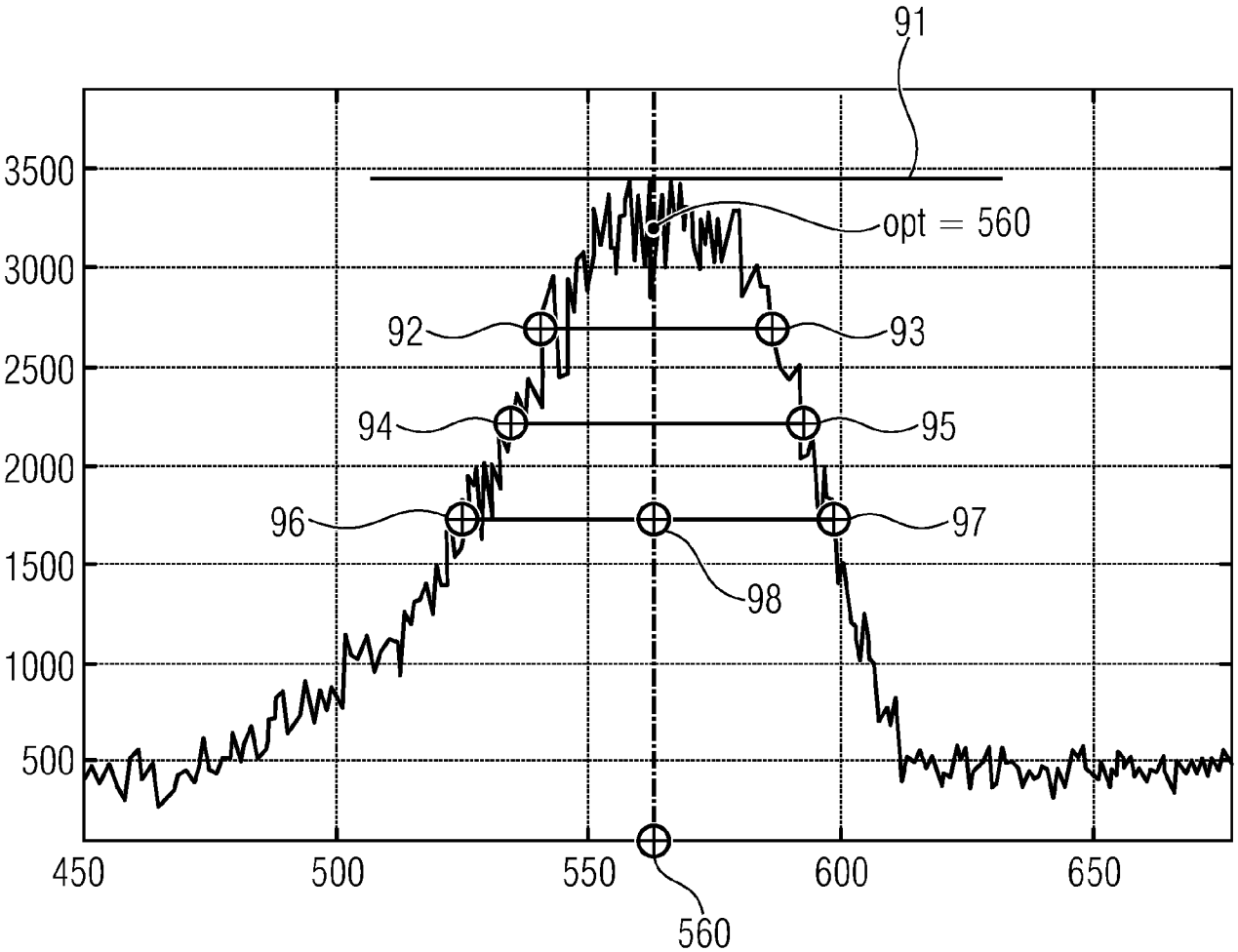
FIG. 9 is a further example of a sensor profile.

FIG. 9 shows a further example of a sensor profile 90. The controller 18 may determine a maximum value of the sensor profile 90 and set this maximum value as a threshold value 91.

Starting from this threshold value 91, the controller 18 may incrementally reduce the threshold value, i.e. to reduce the threshold value step by step. The controller 18 may reduce the threshold value incrementally by single steps, e.g. one unit by one unit, i.e., from 1000 to 999 to 998 and so on, or by multiple steps, e.g., by steps of two or more units.

In the example shown in FIG. 9, the controller 18 may reduce the threshold value one unit by one unit. The maximum threshold value 91 may be a value of 3480 units. Starting from this threshold value 91, the controller 18 may reduce the threshold step by step. The controller 18 may arrive, for example, at a lower threshold value 91A between a pair of nozzle location specific signal characteristics 92, 93. The controller 18 may determine that these two nozzle location specific signal characteristics 92, 93 may be spaced apart from each other by a distance that does not exceed a predetermined distance. Thus, the controller may not take these two nozzle location specific signal characteristics 92, 93 into account in determining the actual position of the drop sensor 17 and continues to incrementally reduce the threshold value.

The controller 18 may arrive, for example, at a next lower threshold value 91B between a pair of next nozzle location specific signal characteristics 94, 95. The controller 18 may determine that these two nozzle location specific signal characteristics 94, 95 may be spaced apart from each other by a distance that does not exceed a predetermined distance. Thus, the controller may not take these two nozzle location specific signal characteristics 94, 95 into account in determining the actual position of the drop sensor 17 and continues to incrementally reduce the threshold value.

The controller 18 may arrive, for example, at a next lower threshold value 91C between a next pair of nozzle location specific signal characteristics 96, 97. The controller 18 may determine that these two nozzle location specific signal characteristics 96, 97 may be spaced apart from each other by a distance that is equal to or above a predetermined distance. Thus, the controller may take these two nozzle location specific signal characteristics 96, 97 into account in determining the actual position of the drop sensor 17. Therefore, the controller 18 may determine the middle point 98 between these two nozzle location specific signal characteristics 96, 97. The middle point 98 is associated with nozzle ID 560, as can be seen on the X-axis of the sensor profile 90 depicted in FIG. 9.

Accordingly, the controller 18 is to incrementally reduce the threshold value of the signal, starting from the determined maximum value 91 to a lower value 91A; 91B; 91C, wherein for each increment, the controller 18 is to determine a relative distance between the two nozzle location specific signal characteristics 92, 93; 94, 95; 96, 97 at the respective threshold value 91A; 91B; 91C until the determined relative distance is equal to or larger than the predetermined distance.

In some examples, the controller 18 may not find a pair of nozzle location specific signal characteristics that are spaced from each other more than a predetermined distance. This may happen, for example, in case of bad signal quality, or if the value for the predetermined distance may have been chosen to be too great such that no pair of nozzle location specific signal characteristics may fulfill this criteria. Thus, the controller 18 is to indicate an error if incrementally reducing the threshold value does not result in a relative distance equal to or larger than the predetermined distance.

Figure 10:
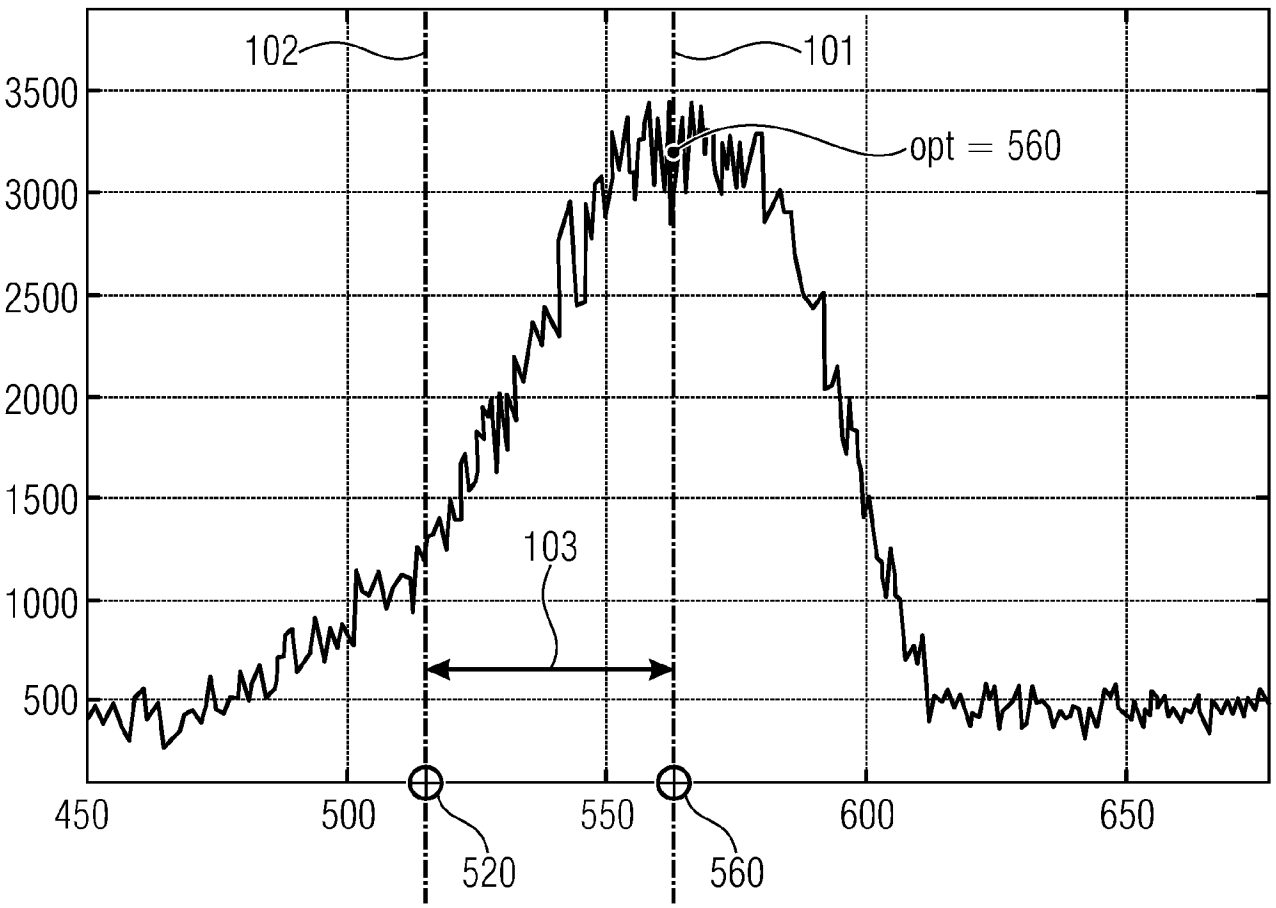
FIG. 10 is a further example of a sensor profile.

As mentioned above, the controller 18 may determine the actual position of the drop sensor 17 relative to the nozzles. FIG. 10 shows an example in which the controller 18 calculates an offset between this determined actual position and a predetermined position of the drop sensor 17.

As can be seen in FIG. 10, the drop sensor 17 may be positioned at a predetermined position 102, for example at nozzle ID 520. However, as previously discussed, the controller 18 may determine that the actual position 101 of the drop sensor 17 may be at nozzle ID 560. In other words, while the drop sensor 17 is expected to be at nozzle position 520, the drop sensor 17 really is at nozzle position 560. Thus, there is an offset 103 of fourty nozzles between the predetermined position 102 and the actual position 101 of the drop sensor 17.

The controller 18 may calculate the offset 103 by determining the relative distance between the predetermined position 102 and the actual position 101 of the drop sensor 17, for example, by subtracting the nozzle ID at the predetermined position 102 from the nozzle ID at the actual position 101 of the drop sensor 17. The controller 18 may take the offset 103 into account in positioning the drop sensor 17 relative to one of the nozzles to detect a liquid drop ejected from that nozzle in a subsequent operation.

An example of a liquid drop detection mechanism in a subsequent operation will be explained in more detail with reference to the following Figures.

Figure 11:
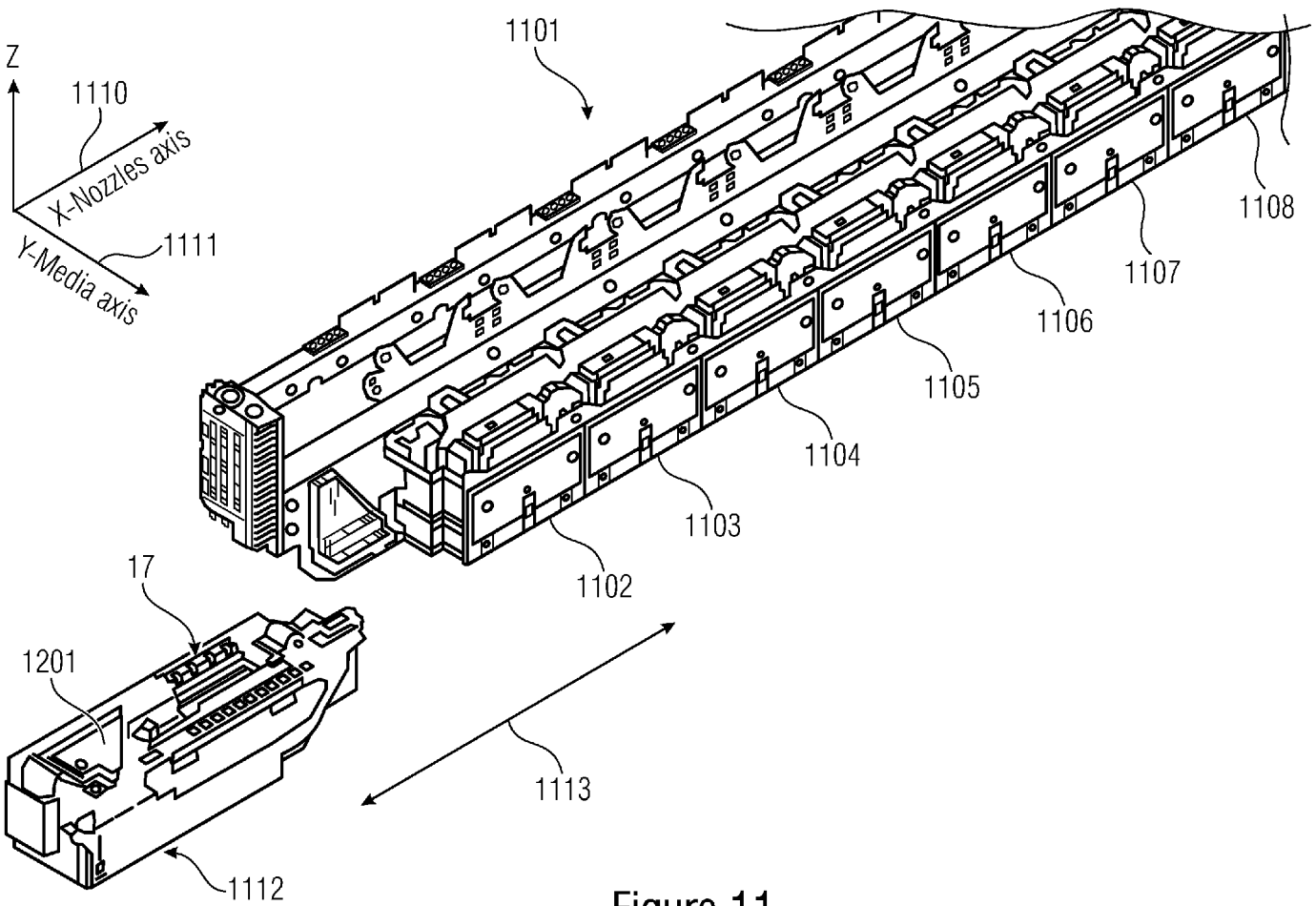
FIG. 11 is a perspective view of an example of a print bar comprising print heads.

FIG. 11 shows an example of a print bar 1101 comprising a plurality of print heads 1102, 1103, 1104, 1105, 1106, 1107, 1108. The print bar 1101 may be installed in a printing apparatus.

The print heads 1102, 1103, 1104, 1105, 1106, 1107, 1108 may comprise nozzles which may be arranged at the bottom of the print heads and which are, therefore, not visible in FIG. 11. The nozzles may be arranged in rows extending in the depicted X-Nozzle axis direction 1110. A medium that is to be printed may be moved underneath the print heads in the depicted Y-Media axis direction 1111.

FIG. 11 further shows an example of an actuator 1112 which may move underneath the print heads in a moving direction 1113. The moving direction 1113 may be substantially parallel to the X-Nozzle axis direction 1110.

The actuator 1112 may comprise drop sensor 17, which will be explained in more detail below with reference to FIG. 12. The drop sensor 17 may be arranged somewhere on top of the actuator 1112, i.e., on a side of the actuator 1112 facing the nozzles of the print heads.

The actuator 1112 may move the drop sensor 17 past the nozzles in the moving direction 1113. The drop sensor 17 may monitor the nozzles in a subsequent operation, i.e., after the controller 18 may have determined the actual position of the drop sensor 17.

During this subsequent operation, the drop sensor 17 may determine whether the nozzles eject liquid drops or not. Therefore, the movement of the drop sensor 17 relative to the nozzles shall be synchronized. Thus, the controller 18 shall be aware of the position of the drop sensor 17 relative to the nozzle to be monitored.

As an example, if a nozzle with nozzle ID '100' is to be monitored by drop sensor 17 in a subsequent operation, then the nozzle with nozzle ID '100' may eject a liquid drop when drop sensor 17 is at the correct position, i.e., at a position associated with nozzle ID '100'. The controller 18 may move the drop sensor 17 to the predetermined position of nozzle with ID '100'. In other words, the controller 18 may position the drop sensor 17 relative to one of the nozzles (e.g., nozzle with ID '100') to detect a liquid drop ejected from that nozzle in a subsequent operation.

If the drop sensor 17 is at this predetermined position, the nozzle with ID '100' ejects a liquid drop which may be detected by the drop sensor 17. If the nozzle with ID '100' may not eject a liquid drop, for example because an ink supply is empty or the nozzle may be clogged, then the drop sensor 17 does not detect a liquid drop. Thus, the controller 18 may get informed by the drop sensor 17 that nozzle with ID '100' is not properly working.

The drop sensor 17 may be moved underneath the nozzles along the moving direction 1113 in a constant movement. Thus, the movement shall be synchronized with the ejection of the liquid drops by the nozzles. Therefore, it is good when the controller 18 is aware of the position of the drop sensor 17.

However, the aforementioned predetermined position may deviate from the actual position of the drop sensor 17, for example, due to manufacturing tolerances or the like. Thus, the controller 18 may determine the actual position of the drop sensor 17, as discussed above, and may take a calculated offset into account in positioning the drop sensor 17 relative to one of the nozzles (e.g., nozzle with ID '100') to detect a liquid drop ejected from that nozzle in the subsequent operation.

For example, if the controller 18 may have calculated an offset of fourty nozzles, then the determined actual position of the drop sensor 17 is the position of nozzle with ID '60', while the predetermined position indicates nozzle with nozzle ID '100' (100−40=60). Accordingly, the controller 18 may take this offset into account. The controller 18 may do so in that it controls, during the subsequent operation, nozzle with ID '100' to eject a liquid drop later in time, namely at a point in time, when the drop sensor 17 is actually at the position of nozzle with ID '100'.

A calculated offset of, for instance, fourty nozzles may also be possible in the other direction. For example, if the controller 18 may have calculated an offset of fourty nozzles, then the determined actual position of the drop sensor 17 is the position of nozzle with ID '140', while the predetermined position indicates nozzle with nozzle ID '100' (100+40=140). Accordingly, the controller 18 may take this offset into account. The controller 18 may do so in that it controls, during the subsequent operation, nozzle with ID '100' to eject a liquid drop earlier in time, namely at a point in time, when the drop sensor 17 is actually at the position of nozzle with ID '100'.

Accordingly, the controller 18 may take the offset into account by delaying or advancing the point of time when the nozzle to be monitored ejects a liquid drop in a subsequent operation, depending on the magnitude of the calculated offset. Thus, the nozzle to be monitored ejects a liquid drop when the drop sensor 17 is actually at the position of that nozzle.

In other words, the actuator 1112 is to move the drop sensor 17 past the nozzles, wherein, in the subsequent operation, the controller 18 is to correct a point in time at which a nozzle ejects a liquid drop based on the calculated offset.

Figure 12:
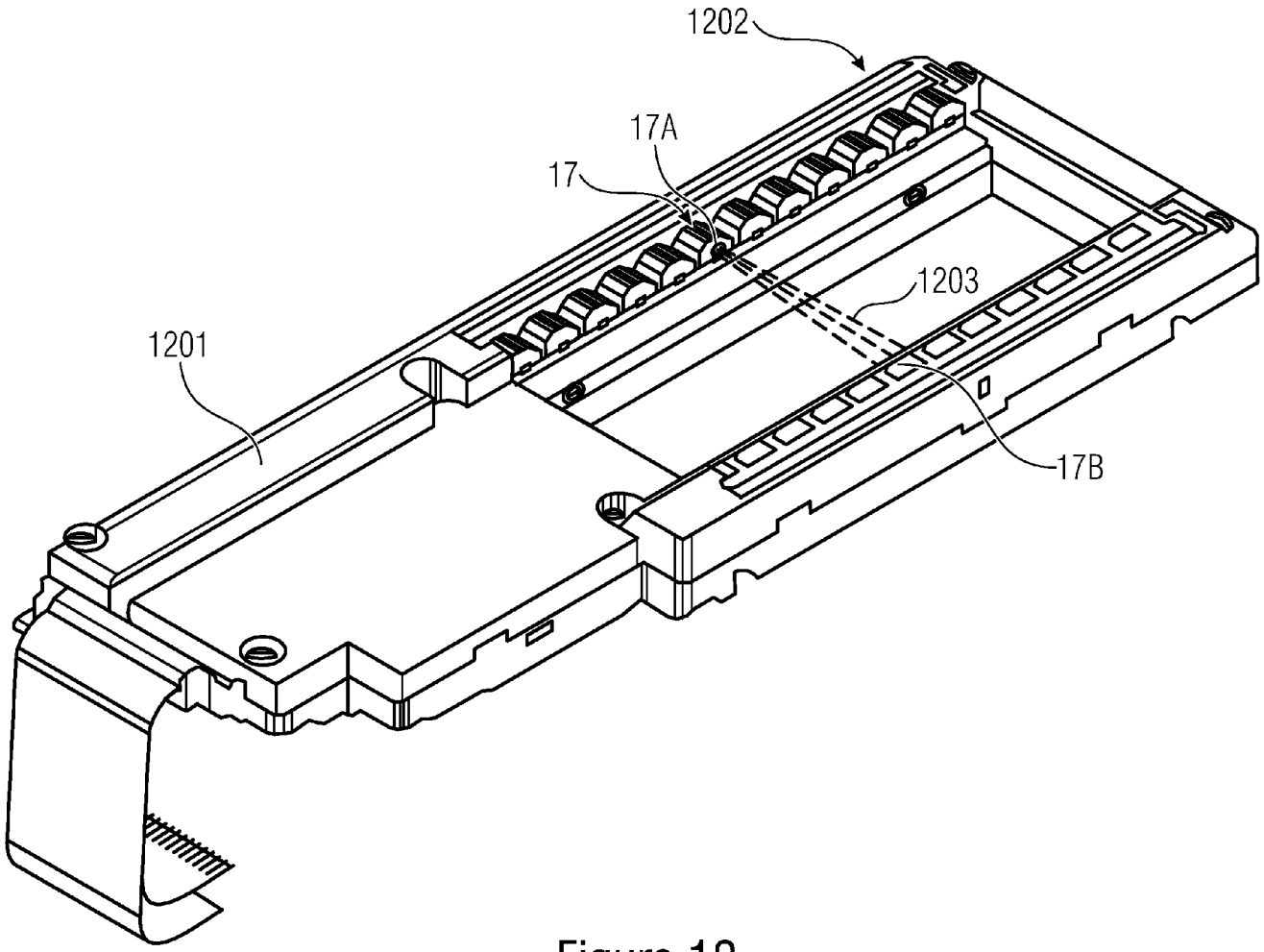
FIG. 12 is a perspective view of an example of an actuator comprising an example of a drop sensor.

FIG. 12 shows an enlarged view of a portion of the actuator 1112 that may move underneath the nozzles. A carriage 1201 may be arranged on top of the actuator 1112, i.e., on a side of the actuator 1112 facing the nozzles of the print heads.

The carriage 1201 may carry a plurality 1202 of drop sensors. As an example, drop sensor 17 is depicted. The drop sensors 1202 may be optical drop sensors comprising a light emitting device 17A and a light receiving device 17B. The light emitting device 17A may emit light in form of a light beam 1203.

The light emitting device 17A may be a light emitting diode, i.e., a LED. The LED may emit red light. The light receiving device 17B may be a photodetector, for example, a photodiode.

The light receiving device 17B may receive at least portions of the light 1203 emitted by the light emitting device 17A. The controller 18 is to position the optical drop sensor 17 relative to a nozzle such that a liquid drop ejected by the nozzles crosses a space between the light emitting device 17A and the light receiving device 17B.

As mentioned above with reference to FIG. 11, the nozzles may be arranged in a row extending in the depicted X-Nozzles axis direction 1110. Back to FIG. 12, it can be seen that the light emitting device 17A and the light receiving device 17B are arranged such that the light beam 1203 between the light emitting device 17A and the light receiving device 17B extends in a direction that is substantially perpendicular to the direction 1110 of the row in which the nozzles are arranged.

Furthermore, the actuator 1112 is to move the drop sensor 17 underneath the print heads 1102, 1103, 1104, 1105, 1106, 1107, 1108 in a direction, i.e., in the movement direction 1113, that is substantially parallel to the direction 1110 of the row in which the nozzles are arranged.

Still with reference to FIG. 12, the plurality 1202 of drop sensors may be arranged in parallel such that the drop sensors 1202 are aligned in a direction that is substantially parallel to the direction 1110 of the row in which the nozzles are arranged.

Figure 13:
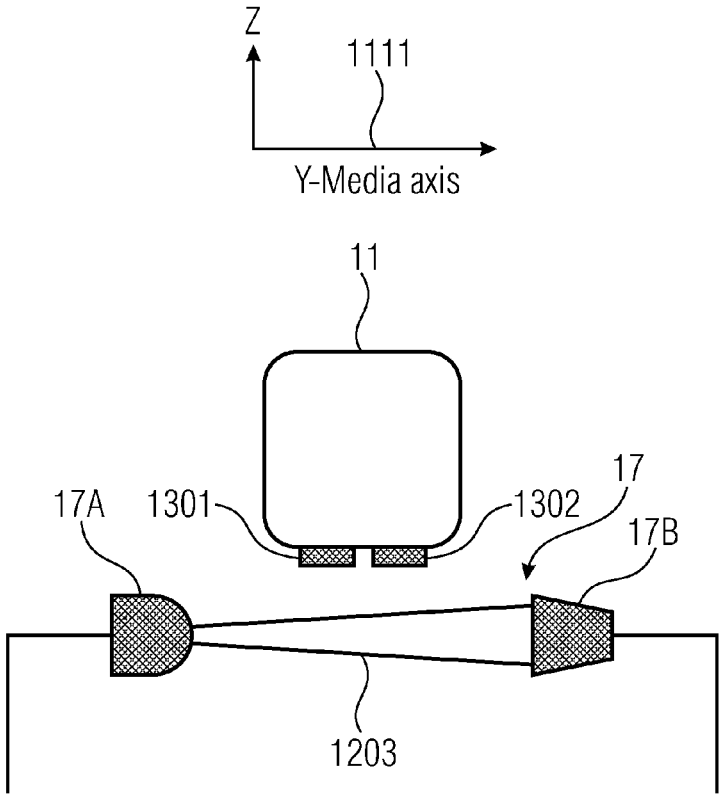
FIG. 13 is a schematic view of an example of an optical drop sensor.
Figure 14:
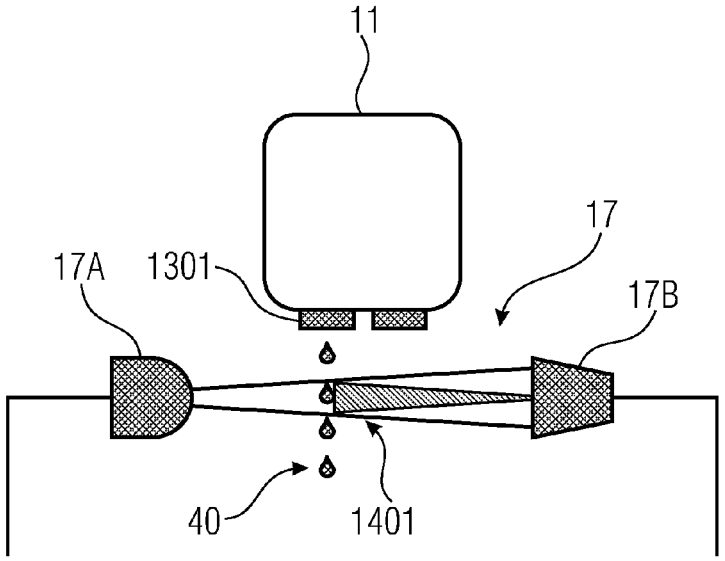
FIG. 14 is a schematic view of a further example of an optical drop sensor.

FIG. 13 and FIG. 14 show an example of an optical drop sensor 17 comprising a light emitting device 17A and a light receiving device 17B. Furthermore, a first group of nozzles is arranged in a first row 1301 and a second group of nozzles is arranged in a second row 1302, wherein the rows 1301, 1302 are arranged such that they extend substantially parallel to each other, and such that the rows 1301, 1302 are positioned behind one another when viewed in the light beam extension direction, i.e., in the Y-Media axis direction 1111.

The light emitting device 17A may emit the light beam 1203 that may be received by the light receiving device 17B. If there is no obstacle between the light emitting device 17A and the light receiving device 17B the light receiving device 17B may receive a maximum portion of the emitted light. Thus, the optical drop sensor 17 may generate a signal having a high signal level, e.g., a high signal strength.

FIG. 14 shows liquid drops 40 that may be ejected by a nozzle provided in the first row 1301. The liquid drops 40 are free falling through the space between the light emitting device 17A and the light receiving device 17B.

The flying liquid drops 40 may represent an obstacle between the light emitting device 17A and the light receiving device 17B. A liquid drop 40 may create a shadow 1401 that may be detectable by the light receiving device 17B. The greater the shadow 1401, the less light may be received by the light receiving device 17B, the higher the signal drop, the smaller the signal level.

The controller 18 may determine a maximum signal level of the drop sensor 17 and a minimum signal level of the drop sensor 17 upon detection of a drop 40 ejected by one of the nozzles. Furthermore, the controller 18 may conduct a peak to peak measurement between the determined minimum and maximum signal levels. Furthermore, the controller 18 may take the result of the peak to peak measurement as the nozzle location specific signal characteristic of the one of the nozzles.

In other words, the controller 18 may create the sensor profile, for example, by the peak to peak measurement mentioned above. Referring back to FIG. 5, the sensor area 32 may be the projected surface of the light beam 1203. As can be seen, liquid drops 40 that are falling in the middle of the light beam, such as liquid drops ejected by nozzle 14, for example, may create a larger shadow than liquid drops that are falling at the edge of the light beam, such as liquid drops ejected by nozzles 12 and 16, for example. The sensor profile 50 may be created by the aforementioned peak to peak measurement. In other words, the controller 18 may take the result of the peak to peak measurement as the nozzle location specific signal characteristic of that one of the nozzles. If the controller 18 may conduct a plurality of peak to peak measurements for a plurality of nozzles, the controller 18 may take the results of the plurality of peak to peak measurements as the respective nozzle location specific signal characteristics of the plurality of nozzles, and create a sensor profile 50 containing a plurality of nozzle location specific signal characteristics.

As described with reference to FIG. 12, the actuator 1201 may comprise a plurality of drop sensors 1202. An arrangement of a plurality of drop sensors 1202 may also be referred to as a drop detector. In an example, the actuator 1201 may comprise twelve drop sensors. Each of the drop sensors may detect or monitor one nozzle or a plurality of nozzles which are arranged in a row.

The controller 18 may determine the actual position of each of the plurality of drop sensors 1202, as described above. Furthermore, the controller 18 may calculate an offset for each of the plurality of drop sensors 1202, as described above. Furthermore, the controller 18 may take the offset of each of the plurality of drop sensors 1202 into account in positioning the plurality of drop sensors 1202 relative to a plurality of nozzles to detect a liquid drop ejected from a respective one of the plurality of nozzles in a subsequent operation. This mechanism which may be executed by the controller 18 may also be referred to as a calibration of the drop sensors.

As each of the plurality of drop sensors may be calibrated as described above, the controller 18 may execute the calibration a number of times that corresponds to the number of drop sensors. In the example of FIG. 12, which shows a drop detector comprising twelve drop sensors, the controller 18 may execute twelve calibrations, i.e., one calibration for each of the twelve sensors.

If the nozzles may be arranged in two parallel rows, such as described by way of example with reference to FIG. 13, then the controller 18 may calibrate each drop sensor for each row separately. Accordingly, the controller 18 may execute twelve calibrations in each row, i.e., twelve calibrations in the first row 1301 and twelve calibrations in the second row 1302. Thus, a total of twenty four calibrations may be executed by the controller 18.

Figure 15:
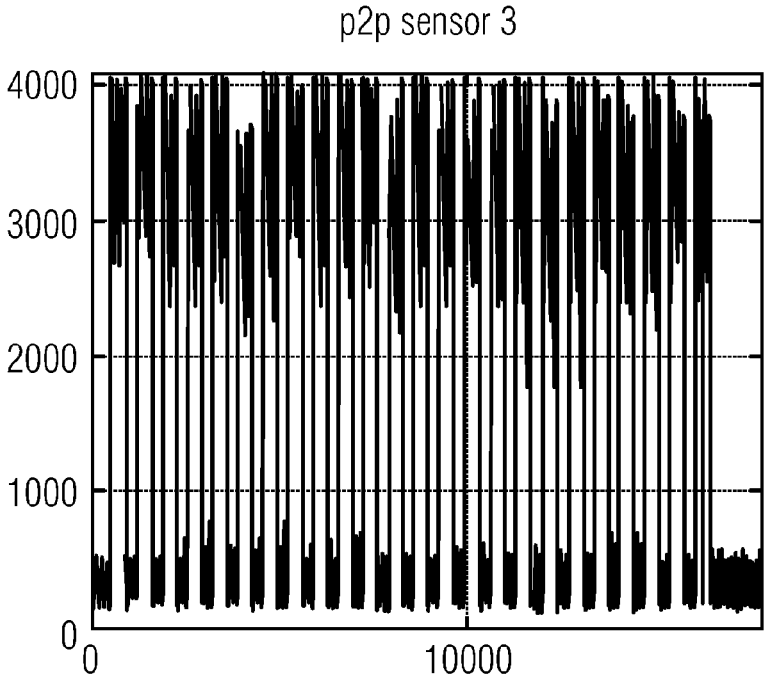
FIG. 15 is an example of a signal captured with a calibrated drop sensor.
Figure 16:
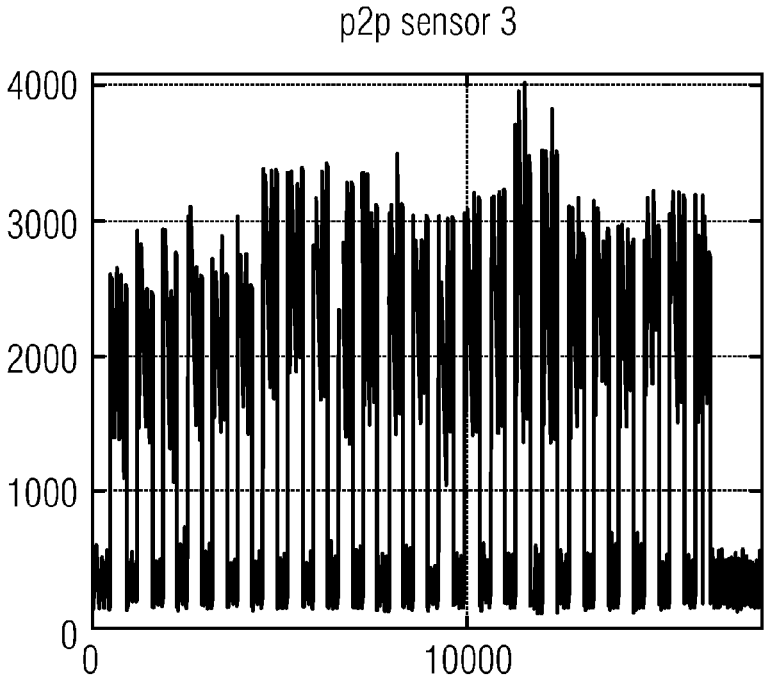
FIG. 16 is an example of a signal captured with an un-calibrated drop sensor.

FIG. 15 shows a signal that has been determined by a drop detector comprising one or more calibrated drop sensors. In comparison, FIG. 16 shows a signal that has been determined by a drop detector comprising one or more uncalibrated drop sensors. As can be seen, the quality of the signal may be better if a calibrated drop sensor may be used. In other words, the signal as depicted in FIG. 16 was determined by a drop sensor in its predetermined position, while the signal as depicted in FIG. 15 was determined by a drop sensor in its actual position that may have been determined by the controller 18, as described above.

Figure 17:
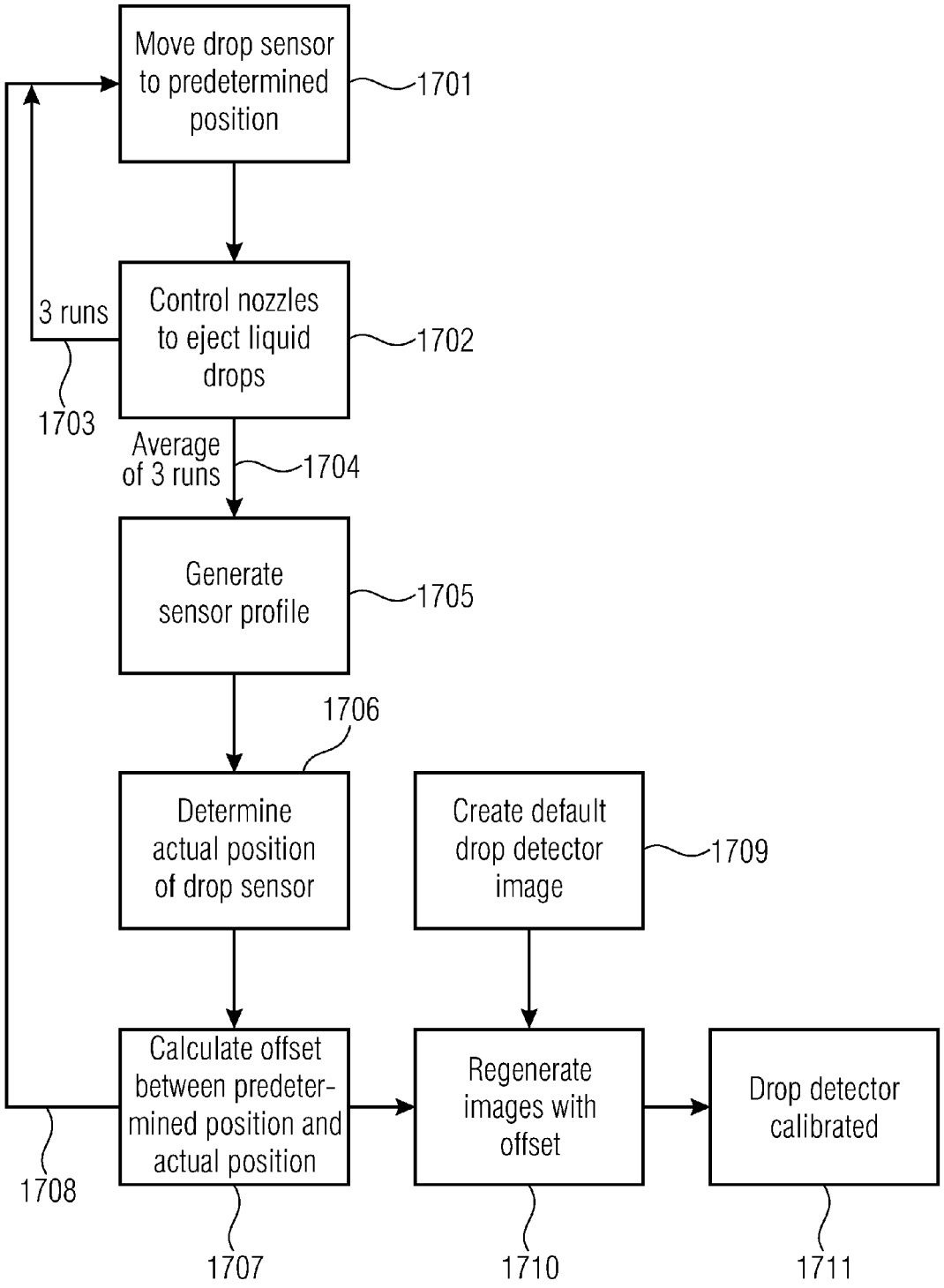
FIG. 17 is a block diagram of a method according to an example.

FIG. 17 shows a block diagram of a method according to an example. At 1701, the drop sensor may be moved to a predetermined position.

At 1702, the controller 18 may control the nozzles to eject liquid drops. As indicated by transition 1703, this procedure may be repeated three times, for example.

As indicated by transition 1704, an average of these three runs may be used for generating a sensor profile at 1705.

At 1706, the actual position of the drop sensor may be determined.

At 1707, an offset between the predetermined position and the actual position of the drop sensor may be calculated.

As indicated by transition 1708, this procedure may be repeated a plurality of times. For example, this procedure may be repeated according to a number of drop sensors to be calibrated and according to a number of rows of nozzles, as described above. For example, this procedure may be repeated twenty four times if twelve drop sensors and two rows of nozzles may be present.

At 1709, a default drop detector image may be generated.

At 1710, images may be regenerated with the respective number of offsets, for example twenty four offsets, that may have been previously determined between 1701 and 1708.

At 1711, the drop detector may be calibrated.

Figure 18:
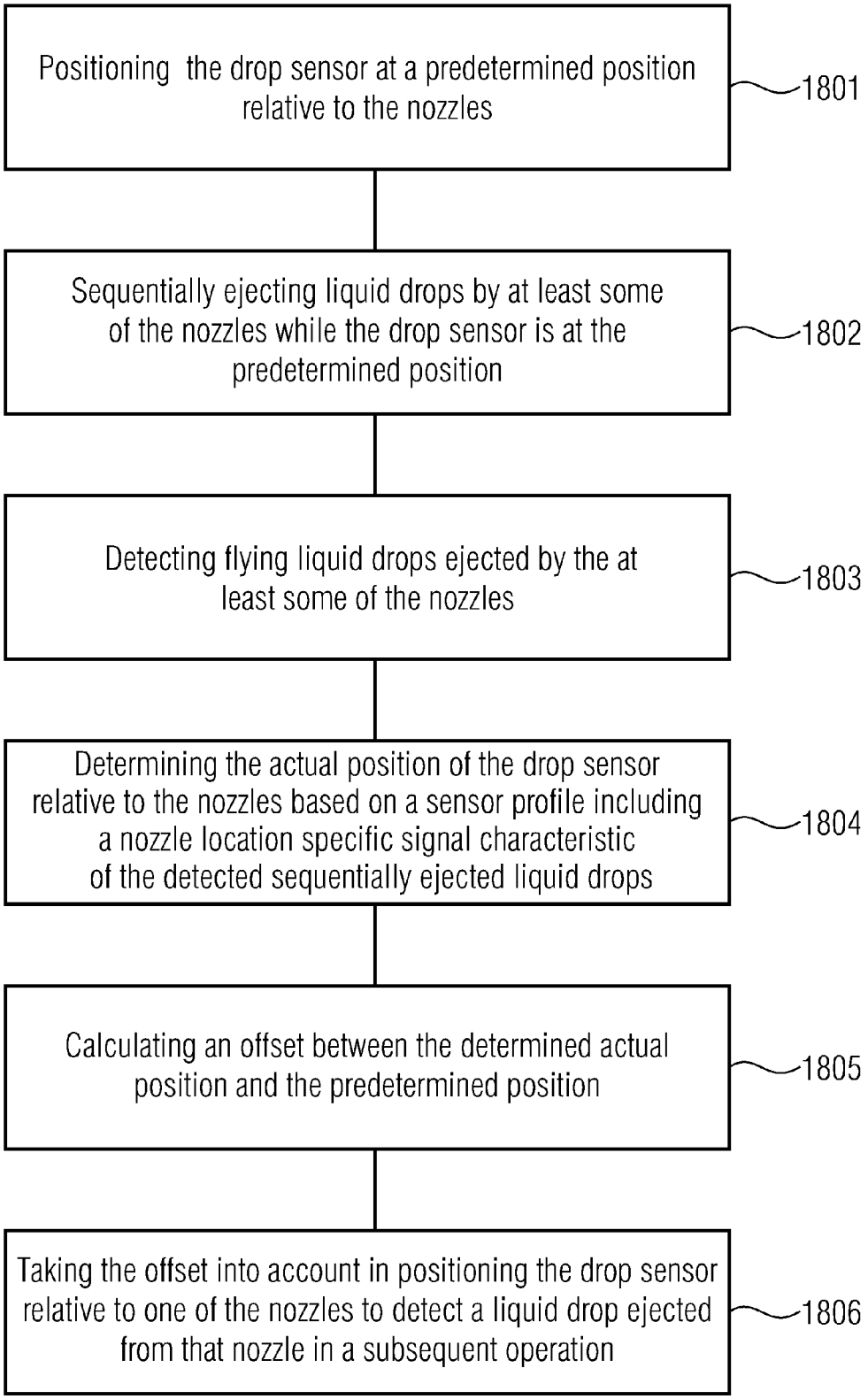
FIG. 18 is a block diagram of a method according to an example.

FIG. 18 shows a block diagram of an example of a method to calibrate a drop sensor for a printing apparatus with a print head including nozzles to eject liquid drops.

At 1801, the drop sensor may be positioned at a predetermined position relative to the nozzles.

At 1802, liquid drops may be sequentially ejected by at least some of the nozzles, while the drop sensor is at the predetermined position.

At 1803, flying liquid drops ejected by the at least some of the nozzles may be detected.

At 1804, the actual position of the drop sensor relative to the nozzles may be determined based on a sensor profile including a nozzle location specific signal characteristic of the detected sequentially ejected liquid drops.

At 1805, an offset between the determined actual position and the predetermined position may be calculated.

At 1806, the offset may be taken into account in positioning the drop sensor relative to one of the nozzles to detect a liquid drop ejected from that nozzle in a subsequent operation.

The position of the blocks which are shown in FIG. 17 and in FIG. 18, respectively, may be interchangeable. In other words, the arrangements of the blocks may not represent a consecutive order of executing the steps associated with these blocks. Stated yet differently, the order of execution may be different from the depicted position of the blocks relative to each other.

Examples relate to a non-transitory machine-readable storage medium encoded with instructions executable by a processing resource of a computing device to perform methods described herein.

Examples described herein can be realized in the form of hardware, machine readable instructions or a combination of hardware and machine readable instructions. Any such machine readable instructions may be stored in the form of volatile or non-volatile storage such as, for example, a storage device like a ROM, whether erasable or rewriteable or not, or in the form of memory such as, for example, RAM, memory chips, device or integrated circuits or an optically or magnetically readable medium such as, for example, a CD, DVD, magnetic disk or magnetic tape. The storage devices and storage media are examples of machine-readable storage that are suitable for storing a program or programs that, when executed, implement examples described herein.

All of the features disclosed in the specification (including any accompanying claims, abstract and drawings), and/or all the features of any method or progress disclosed may be combined in any combination (including any claim combination), except combinations where at least some of such features are mutually exclusive. In addition, features disclosed in connection with a system may, at the same time, present features of a corresponding method, and vice versa.

Each feature disclosed in the specification (including any accompanying claims, abstract and drawings) may be replaced by alternative features serving the same, equivalent or similar purpose, unless expressly stated otherwise. Thus, unless expressly stated otherwise, each feature disclosed is one example of a generic series of equivalent or similar features.

The foregoing has described the principles, examples and modes of operation. However, the teaching herein should not be construed as being limited to the particular examples described. The above-described examples should be regarded as illustrative rather than restrictive, and it should be appreciated that variations may be made in those examples by workers skilled in the art without departing from the scope of the present invention as defined by the following claims.

The invention claimed is:

1. A printing apparatus comprising:

a print head including nozzles to eject liquid drops;

a drop sensor to detect flying liquid drops ejected by at least some of the nozzles;

a controller to control at least some of the nozzles to sequentially eject liquid drops while the drop sensor is at a predetermined position relative to the nozzles, determine the actual position of the drop sensor relative to the nozzles based on a sensor profile including a nozzle location specific signal characteristic of the sequentially ejected liquid drops detected by the drop sensor, calculate an offset between the determined actual position and the predetermined position, and take the offset into account in positioning the drop sensor relative to one of the nozzles to detect a liquid drop ejected from that nozzle in a subsequent operation.

2. The printing apparatus of claim 1, wherein the sensor profile has a global maximum, and wherein the controller is to determine the actual position of the drop sensor depending on the global maximum of the sensor profile.

3. The printing apparatus of claim 1, wherein the controller is to determine the actual position as the middle point between two nozzle location specific signal characteristics having the same value and being associated with nozzles spaced apart by more than a predetermined distance.

4. The printing apparatus of claim 3, wherein the controller is to determine a maximum value of the sensor profile and to set this maximum value as a threshold value.

5. The printing apparatus of claim 4, wherein the controller is to incrementally reduce the threshold value of the signal, starting from the determined maximum value to a lower value, wherein for each increment, the controller is to determine a relative distance between the two nozzle location specific signal characteristics at the respective threshold value until the determined relative distance is equal to or larger than the predetermined distance.

6. The printing apparatus of claim 5, wherein the controller is to indicate an error if incrementally reducing the threshold value does not result in a relative distance equal to or larger than the predetermined distance.

7. The printing apparatus of claim 6, comprising an actuator to move the drop sensor past the nozzles, wherein, in the subsequent operation, the controller is to correct a point in time at which a nozzle ejects a liquid drop based on the calculated offset.

8. The printing apparatus of claim 1, wherein the drop sensor is an optical drop sensor comprising a light emitting device and a light receiving device, the light receiving device to receive at least portions of the light emitted by the light emitting device, wherein the controller is to position the optical drop sensor relative to a nozzle such that a liquid drop ejected by the nozzles crosses a space between the light emitting device and the light receiving device.

9. The printing apparatus of claim 8, wherein the nozzles are arranged in a row and wherein the light emitting device and the light receiving device are arranged such that a light beam between the light emitting device and the light receiving device extends in a direction that is substantially perpendicular to the row in which the nozzles are arranged.

10. The printing apparatus of claim 9, wherein the actuator is to move the drop sensor underneath the print head in a direction that is substantially parallel to the row in which the nozzles are arranged.

11. The printing apparatus of claim 9, comprising a plurality of drop sensors which are arranged in parallel such that the drop sensors are aligned in a direction that is substantially parallel to the row in which the nozzles are arranged.

12. The printing apparatus of claim 9, wherein a first group of nozzles is arranged in a first row and a second group of nozzles is arranged in a second row, wherein the rows are arranged such that they extend substantially parallel to each other, and such that the rows are positioned behind one another when viewed in the light beam extension direction.

13. The printing apparatus of claim 1, wherein the controller is to determine a maximum signal level of the drop sensor and a minimum signal level of the drop sensor upon detection of a drop ejected by one of the nozzles, to conduct a peak to peak measurement between the determined minimum and maximum signal levels, and to take the result of the peak to peak measurement as the nozzle location specific signal characteristic of the one of the nozzles.

14. A method to calibrate a drop sensor for a printing apparatus with a print head including nozzles to eject liquid drops, the method comprising:

positioning the drop sensor at a predetermined position relative to the nozzles, sequentially ejecting liquid drops by at least some of the nozzles, while the drop sensor is at the predetermined position, detecting flying liquid drops ejected by the at least some of the nozzles, determining the actual position of the drop sensor relative to the nozzles based on a sensor profile including a nozzle location specific signal characteristic of the detected sequentially ejected liquid drops, calculating an offset between the determined actual position and the predetermined position, and taking the offset into account in positioning the drop sensor relative to one of the nozzles to detect a liquid drop ejected from that nozzle in a subsequent operation.

15. A non-transitory machine-readable storage medium encoded with instructions executable by a processing resource of a computing device to perform a calibration of a drop sensor for a printing apparatus with a print head including nozzles to eject liquid drops, the calibration comprising:

positioning the drop sensor at a predetermined position relative to the nozzles, sequentially ejecting liquid drops by at least some of the nozzles, while the drop sensor is at the predetermined position, detecting flying liquid drops ejected by the at least some of the nozzles, determining the actual position of the drop sensor relative to the nozzles based on a sensor profile including a nozzle location specific signal characteristic of the detected sequentially ejected liquid drops, calculating an offset between the determined actual position and the predetermined position, and taking the offset into account in positioning the drop sensor relative to one of the nozzles to detect a liquid drop ejected from that nozzle in a subsequent operation.

* * * * *